US010689795B2

(12) United States Patent
Yan et al.

(10) Patent No.: US 10,689,795 B2
(45) Date of Patent: Jun. 23, 2020

(54) IRONING HEAD WITH AUXILIARY ACCESSORY

(71) Applicant: NINGBO KAIBO GROUP CO., LTD., Ningbo, Zhejiang (CN)

(72) Inventors: Jiebo Yan, Zhejiang (CN); Huomu Lin, Zhejiang (CN)

(73) Assignee: NINGBO KAIBO GROUP CO., LTD., Ningbo, Zhejiang (CN)

( * ) Notice: Subject to any disclaimer, the term of this patent is extended or adjusted under 35 U.S.C. 154(b) by 96 days.

(21) Appl. No.: 15/965,777

(22) Filed: Apr. 27, 2018

(65) Prior Publication Data

US 2019/0234006 A1 Aug. 1, 2019

(30) Foreign Application Priority Data

Jan. 26, 2018 (CN) ..... 2018 1 0077143
Jan. 26, 2018 (CN) ..... 2018 2 0135207 U

(51) Int. Cl.
*D06F 79/00* (2006.01)
*D06F 75/20* (2006.01)

(52) U.S. Cl.
CPC ..... *D06F 79/00* (2013.01); *D06F 75/20* (2013.01)

(58) Field of Classification Search
CPC ..... D06F 79/00; D06F 75/14; D06F 75/20; D06F 75/26; D06F 75/38; D06F 75/40; D06F 73/00; D06F 87/00; A47L 5/24; A45D 20/12; A45D 20/122; A45D 20/124; A45D 20/18; H05B 3/00; H05B 3/0071
See application file for complete search history.

(56) References Cited

U.S. PATENT DOCUMENTS 3,675,449 A * 7/1972 Bluestein ..... D06F 5/30 68/222
4,032,747 A * 6/1977 Kunz ..... A45D 1/04 219/222
4,583,260 A * 4/1986 Zai ..... A01N 47/34 15/320

(Continued)

FOREIGN PATENT DOCUMENTS

FR 2426210 A * 1/1980

*Primary Examiner* — Ismael Izaguirre
(74) *Attorney, Agent, or Firm* — Global IP Services; Tianhua Gu

(57) ABSTRACT

Disclosed is an ironing head with an auxiliary accessory, which overcomes the defects of complicated disassembling and assembling operations caused by split configuration of an auxiliary accessory and a main body, the tendency to lose the auxiliary accessory, and the tendency to scald hands. The main body is provided with a neck adjacent to an ironing panel; the auxiliary accessory is movably sleeved on the neck to move back and forth on the neck; and lock-up structures for positioning the auxiliary accessory at the working position are disposed between the auxiliary accessory and the main body. The auxiliary accessory works near the ironing panel. The auxiliary accessory is bound with the machine body. During use, the service mode is changed only by changing the position of the auxiliary accessory. The configuration method of the auxiliary accessory ensures no contact with the ironing panel during movement, avoiding scalding of the hands.

12 Claims, 10 Drawing Sheets

(56) References Cited

U.S. PATENT DOCUMENTS

| | | | | |
|---|---|---|---|---|
| 5,604,985 | A * | 2/1997 | Andis | B26B 19/06 30/132 |
| 6,738,564 | B1 * | 5/2004 | Tung | F24H 3/0423 239/288.5 |
| 7,188,442 | B2 * | 3/2007 | Fernandez | D06F 5/40 38/81 |
| 8,407,913 | B2 * | 4/2013 | Langley | A45D 20/12 132/271 |
| 2005/0040644 | A1 * | 2/2005 | Tawara | A47L 9/242 285/7 |

* cited by examiner

IRONING HEAD WITH AUXILIARY ACCESSORY

BACKGROUND OF THE INVENTION

1. Technical Field

The present invention belongs to ironing equipment, and specifically relates to an ironing head with an auxiliary accessory.

2. Description of Related Art

Irons have previously been employed to iron clothes. On the current market, similar products such as steam brushes and garment steamers are available. An invention patent with an authorized publication number CN204626112U discloses a steam brush, and invention patent applications with the publication numbers CN104911886A and CN104805668A both disclose a garment steamer.

Hand-held steam brushes and garment steamers both have ironing heads (also called spray heads) which spray steam out for ironing clothes. During clothes ironing, sometimes it is necessary to use an accessory (such as a hair brush) to handle clothes. Therefore, hand-held steam brushes and garment steamers are configured with an auxiliary accessory. The auxiliary accessory and ironing head are separated. When a user needs to use an auxiliary accessory to perform ironing, the auxiliary accessory needs to be fixed on the machine body. After such ironing mode is completed, another ironing mode begins (for example, dry ironing on a panel with a temperature), and the auxiliary accessory is required to be dismantled to be placed independently or stored. Doing so brings the following defects:

1. It is very inconvenient for a user to dismantle and install auxiliary accessories.
2. Auxiliary accessories like the hair brush easily get lost.
3. Users may be easily scalded by the ironing panel when dismantling the auxiliary accessories.

BRIEF SUMMARY OF THE INVENTION

The technical problem to be solved and the technical task to be put forward by the present invention is to provide an ironing head with an auxiliary accessory to overcome the defects of complicated disassembling and assembling operations caused by split configuration of the auxiliary accessory and the main body, the tendency to lose the auxiliary accessory, and the tendency of scalding by the ironing panel during dismantling.

In order to achieve the above objectives, the ironing head with an auxiliary accessory of the present invention includes a main body and an auxiliary accessory. An ironing panel is disposed at the front end of the main body. The present invention is characterized in that the main body is provided with a neck adjacent to the ironing panel; the auxiliary accessory is movably sleeved on the neck; lock-up structures for at least positioning the auxiliary accessory at the working position are disposed between the auxiliary accessory and the main body, where the working position refers to the position, close to the ironing panel, of the auxiliary accessory sleeved on the neck.

As a preferable technical means, the lock-up structures position the auxiliary accessory at an accommodating position, where the accommodating position refers to a position, away from the ironing panel, of the auxiliary accessory sleeved on the neck.

As a preferable technical means, the auxiliary accessory is ring-shaped; each one of the lock-up structures includes a positioning groove and a spring bolt that are respectively disposed on the auxiliary accessory and the neck; each one of the spring bolts is positioned in each corresponding one of the positioning grooves to position the auxiliary accessory at the neck.

As a preferable technical means, the auxiliary accessory is ring-shaped; each one of the lock-up structures includes a lock, a spring and a stopper portion; the stopper portions are disposed at the neck; the locks are equipped on the auxiliary accessory in a telescoping way and protrude out on the surface of the auxiliary accessory to facilitate pressing; each one of the springs applies an outward spring force to each corresponding one of the locks to maintain each corresponding one of the locks at each corresponding one of positions blocked by each corresponding one of the stopper portions; pressing each one of the locks overcomes the spring force of each corresponding one of the springs to move each one of the locks inward so as to avoid blocking by each corresponding one of the stopper portions.

As a preferable technical means, the neck is provided with slits; each one of the stopper portions is positioned at an edge of each corresponding one of the slits and protrudes towards the inside of each corresponding one of the slits; each one of the locks has a rod portion; each one of the rod portions extends into each corresponding one of the slits and is provided with a lateral bolt at the inner end; each one of the bolts is maintained by the spring force of each corresponding one of the springs at the position blocked by each corresponding one of the stopper portions; pressing each one of the locks overcomes the spring force of each corresponding one of the springs to move each corresponding one of the bolts inward so as to avoid blocking by each corresponding one of the stopper portions.

As an optimal technical means, each one of the springs is sleeved on each corresponding one of the rod portions.

As an optimal technical means, each one of the stopper portions are positioned at the middle portion of each corresponding one of the slits such that the front and rear sides of each one of the stopper portions are both positioned in each corresponding one of the slits.

As an optimal technical means, each one of the springs is a spiral compression spring with two ends respectively supported on the auxiliary accessory and each corresponding one of the locks.

As an optimal technical means, each one of the locks is provided with two lateral hooks, and the lateral hooks are positioned on the inner side of the auxiliary accessory to realize assembling of the locks and the auxiliary accessory.

As an optimal technical means, two lock-up structures are symmetrically provided.

As an optimal technical means, the auxiliary accessory is provided with a wrench, and the wrench keeps a distance away from the ironing panel.

As an optimal technical means, the auxiliary accessory is provided with a hair brush or an electrostatic cloth brush.

As an optimal technical means, the main body is connected with a steam pipe which is connected with the steam generator.

As an optimal technical means, the main body is assembled with a water tank and a steam generator.

In the present invention, the main body is provided with the neck adjacent to the ironing panel; the auxiliary accessory is movably sleeved on the neck to move back and forth on the neck; and the lock-up structures for positioning the auxiliary accessory at the working position are disposed between the auxiliary accessory and the main body. Thus, the auxiliary accessory performs ironing near the ironing panel. In this solution, the auxiliary accessory is bound with the machine body to avoid loss; during use, the service mode is changed only by changing the position of the auxiliary accessory, so the operation is convenient; the configuration manner of the auxiliary accessory ensures no contact with the ironing panel during movement, avoiding scalding of the hands.

DESCRIPTION OF MARKS IN THE DRAWINGS

Figure 1:
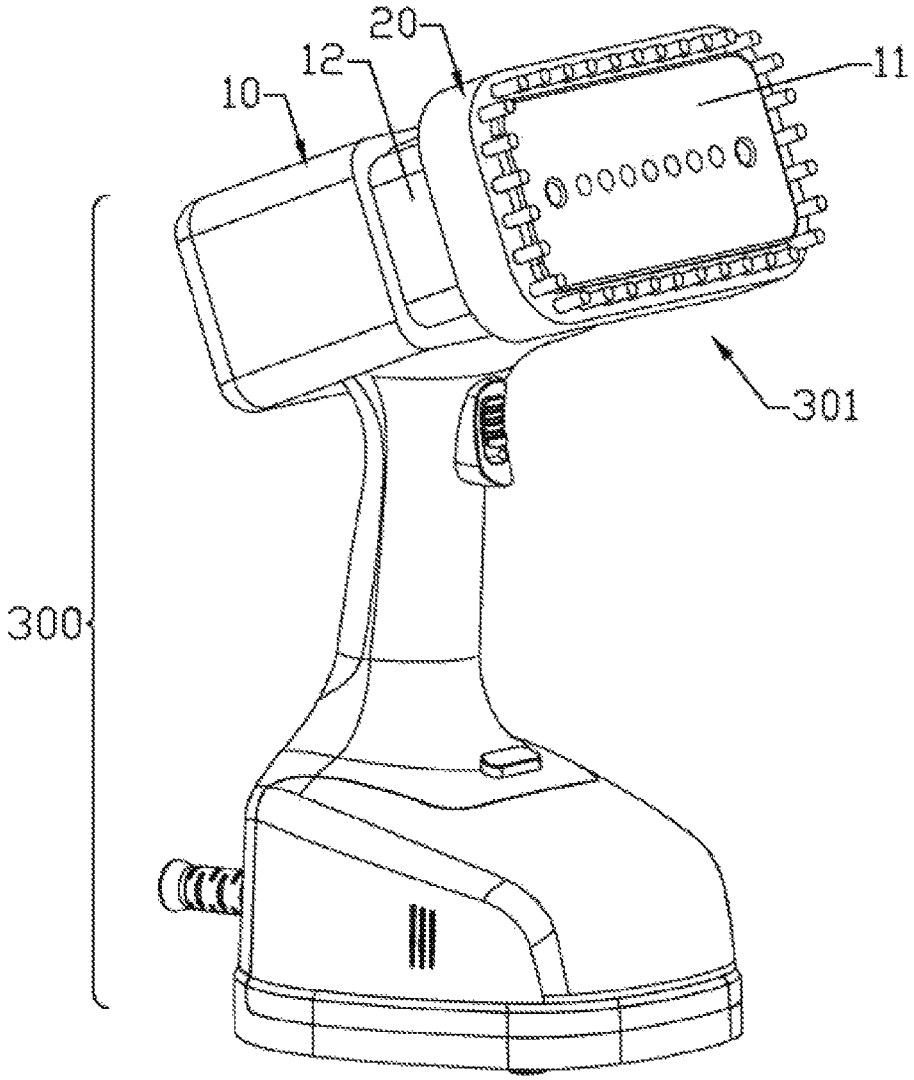
FIG. 1 is a schematic view of an embodiment of an ironing head with an auxiliary accessory of the present invention applied to a steam brush.

10-Main body; 11-ironing panel; 12-neck; 13-spring bolt;
20-auxiliary accessory; 21-positioning groove;
100-main body; 101-ironing panel; 102-neck; 103-stopper portion; 104-slit;
200-auxiliary accessory; 201-lock; 202-spring; 203-rod portion; 204-bolt;
205-lateral hook;
300-steam brush; 301-ironing head; 302-ironing head;
400-garment steamer; 401-ironing head; 402-steam pipe.

DETAILED DESCRIPTION OF THE INVENTION

The present invention is described in further detail in conjunction with the drawings attached to the description.

Embodiment 1

An ironing head with an auxiliary accessory as shown in FIG. 1-5 includes a main body 10 and an auxiliary accessory 20. An ironing panel 11 is disposed at the front end of the main body 10. The main body 10 is provided with a neck 12 adjacent to the ironing panel; the auxiliary accessory 20 is movably sleeved on the neck 12; and lock-up structures for positioning the auxiliary accessory at the working position are disposed between the auxiliary accessory 20 and the main body 10, where the working position refers to the position, close to the ironing panel, of the auxiliary accessory sleeved on the neck.

The auxiliary accessory 20 is ring-shaped; each one of the lock-up structures includes a positioning groove 21 and a spring bolt 13 that are respectively disposed on the auxiliary accessory and the neck, and each one of the spring bolts 13 is positioned in each corresponding one of the positioning grooves 21 to position the auxiliary accessory at the neck. As shown in the figure, two lock-up structures are symmetrically provided, which means that the positioning grooves and the spring bolts are disposed on the upper and lower sides of the neck and on the auxiliary accessory. During specific implementation, the lock-up structures may also be disposed on the left and right sides of the neck and on the auxiliary accessory.

The ironing head 301 with the auxiliary accessory is applied to a steam brush 300 to become the head of the steam brush, and the ironing head 301 is internally provided with a steam generator (not shown in the figure). As shown in the figure, the steam brush also includes a water tank which forms a part of the machine body, and a gripping portion. When the steam brush is working, a water pump (not shown in the figure) delivers water in the water tank to the steam generator, and the steam generator converts water into steam and sprays the steam out via the ironing panel to perform ironing.

Figure 2:
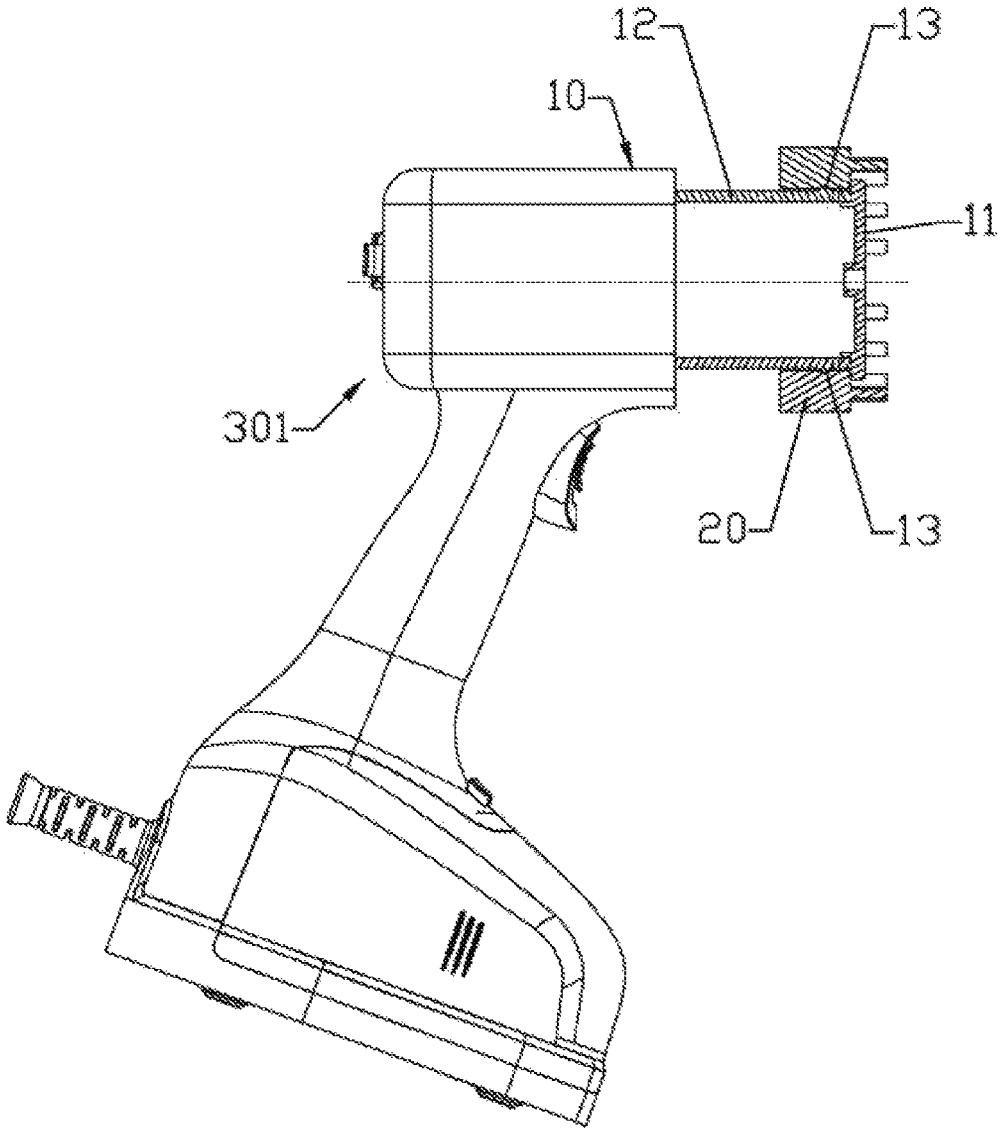
FIG. 2 is a lateral partial sectional view of the steam brush in FIG. 1.
Figure 3:
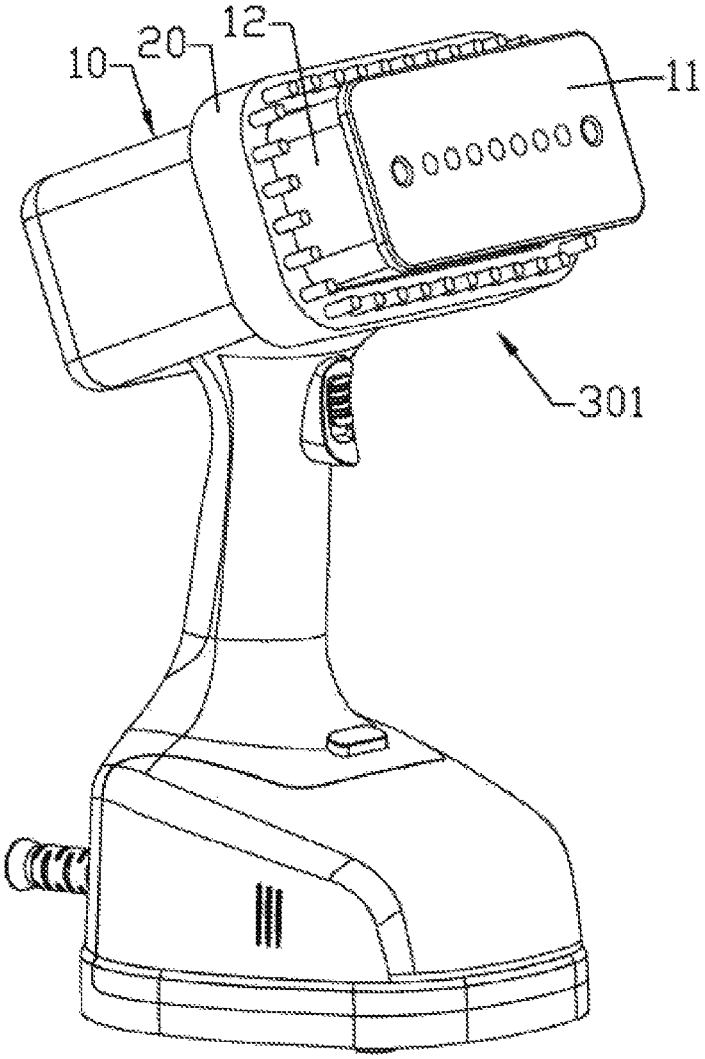
FIG. 3 is a schematic view in which the auxiliary accessory in FIG. 1 leaves the position of the ironing panel.
Figure 4:
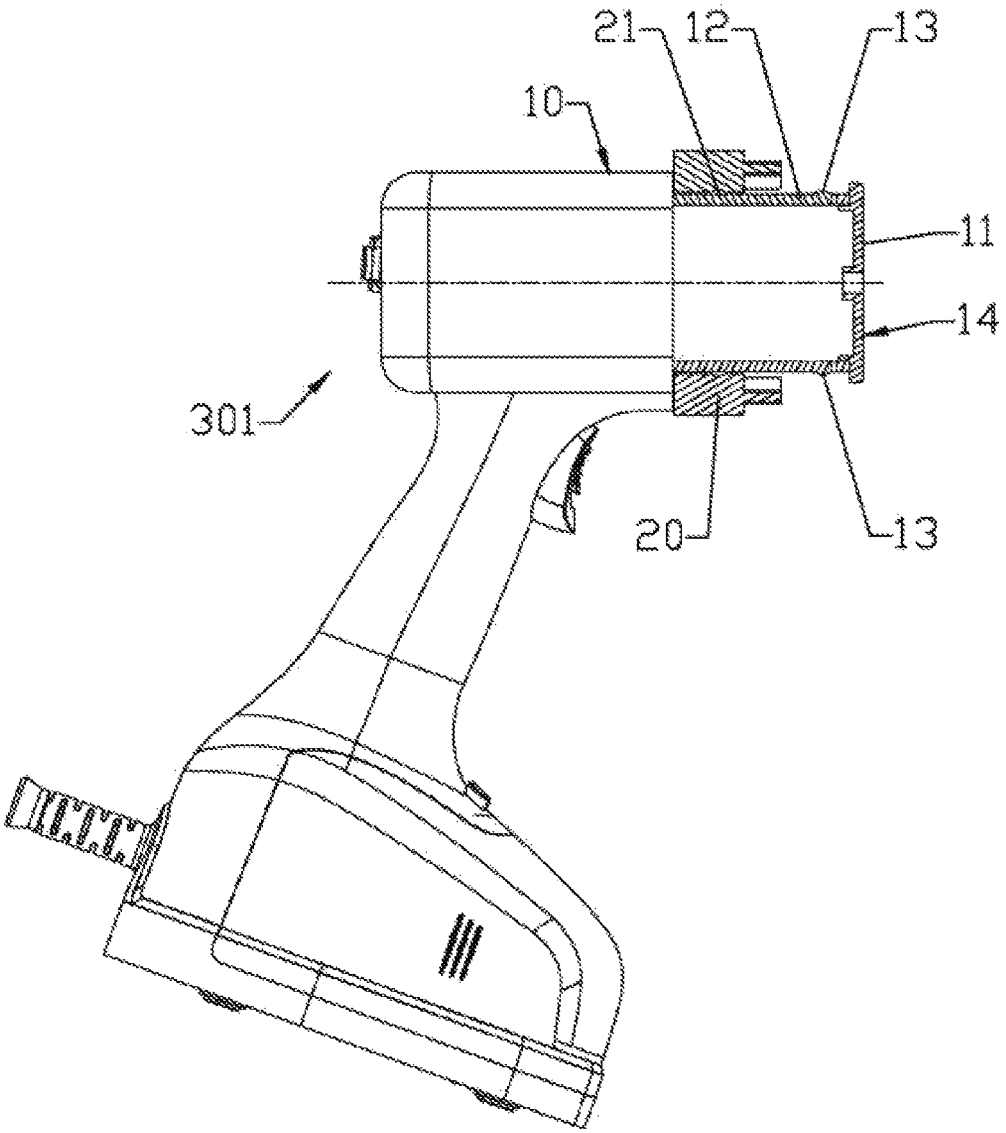
FIG. 4 is a lateral partial sectional view of the steam brush in FIG. 3.
Figure 5:
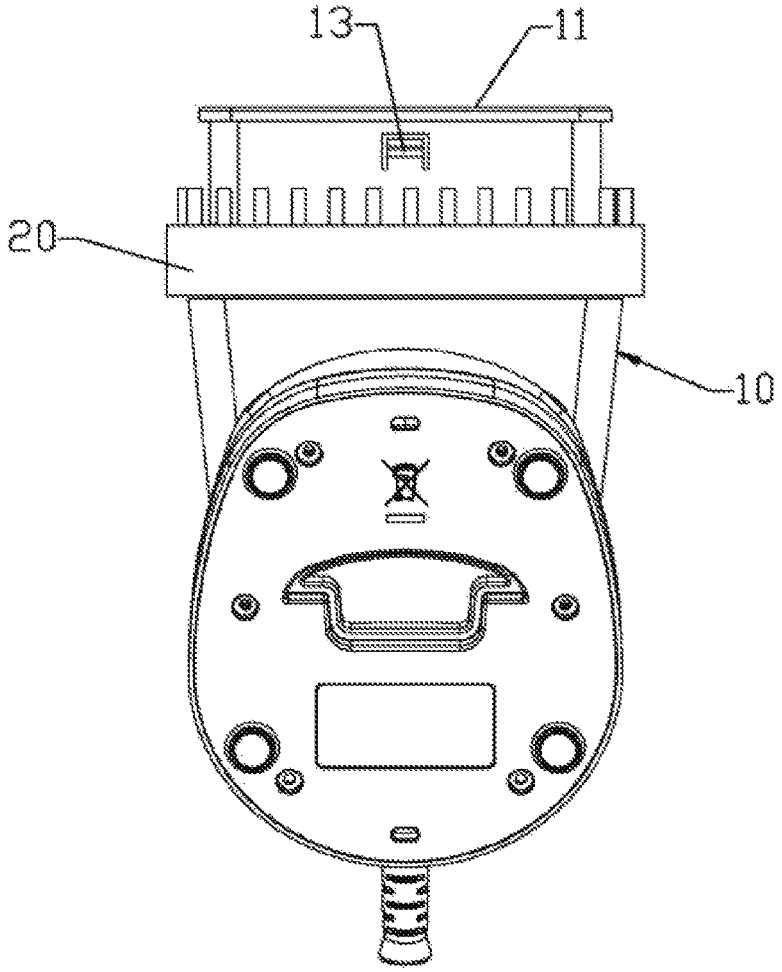
FIG. 5 is a top front projection view of the structure as shown in FIG. 3.

During use, the auxiliary accessory may be moved to the working position to be positioned by the lock-up structures (refer to FIGS. 1-2). After use, the auxiliary accessory is moved backward to leave the ironing panel (refer to FIGS. 3-4). When necessary, identical lock-up structures may be provided to lock and position the auxiliary accessory at an accommodating position, where the accommodating position refers to a position, away from the ironing panel, of the auxiliary accessory sleeved on the neck. A user always keeps his/her hands away from the high-temperature zone of the ironing panel when operating the auxiliary accessory, thus avoiding scalding.

Embodiment 2

Figure 6:
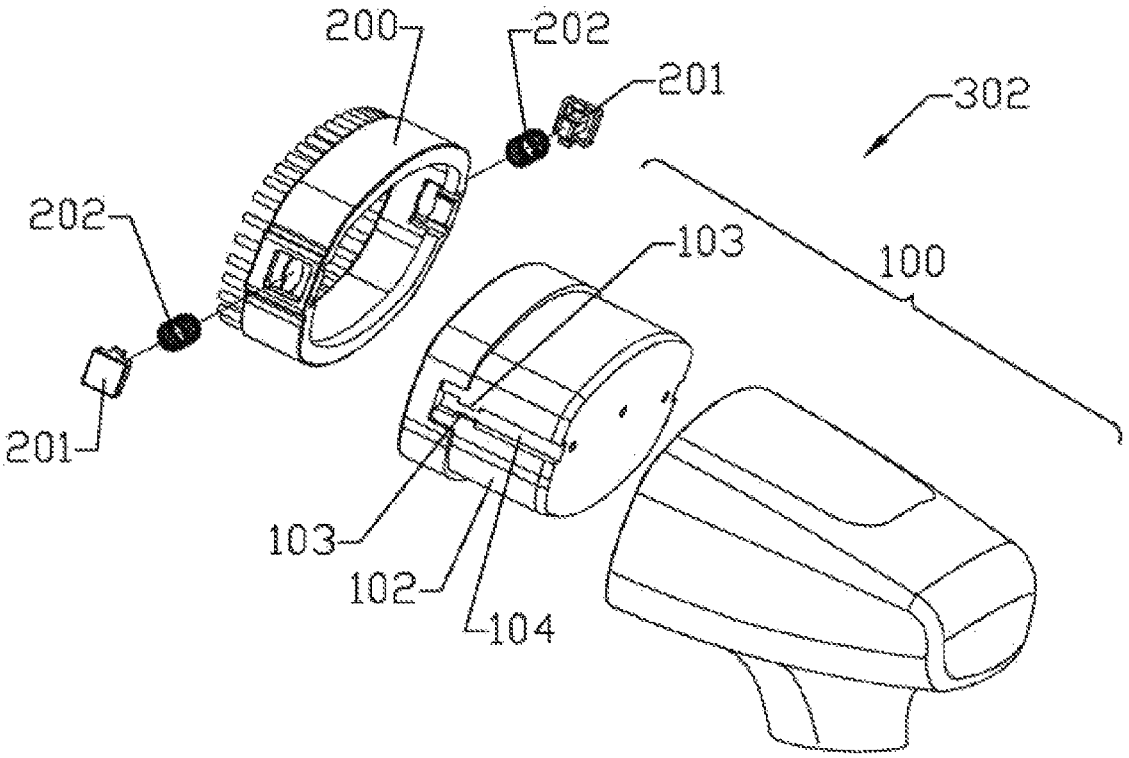
FIG. 6 is an exploded view of another embodiment of an ironing head with an auxiliary accessory of the present invention applied to a steam brush.
Figure 9:
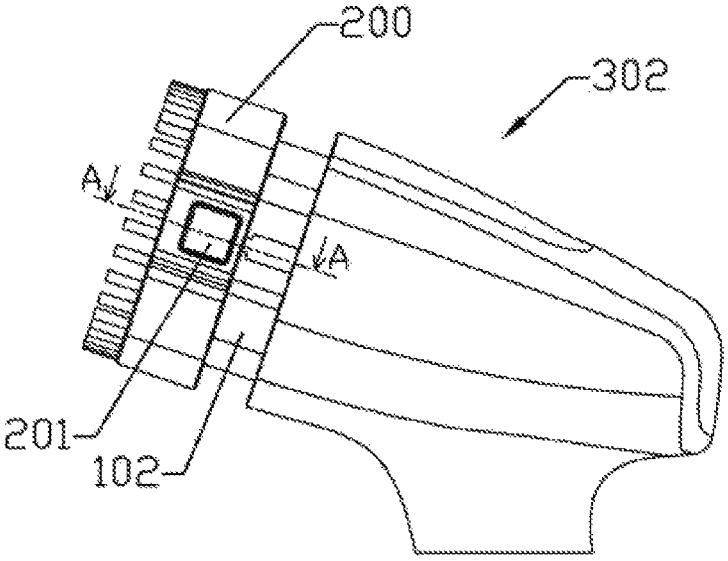
FIG. 9 is a schematic view in which the auxiliary accessory is located at the working position when the structures in FIG. 6 are assembled together.
Figure 10:
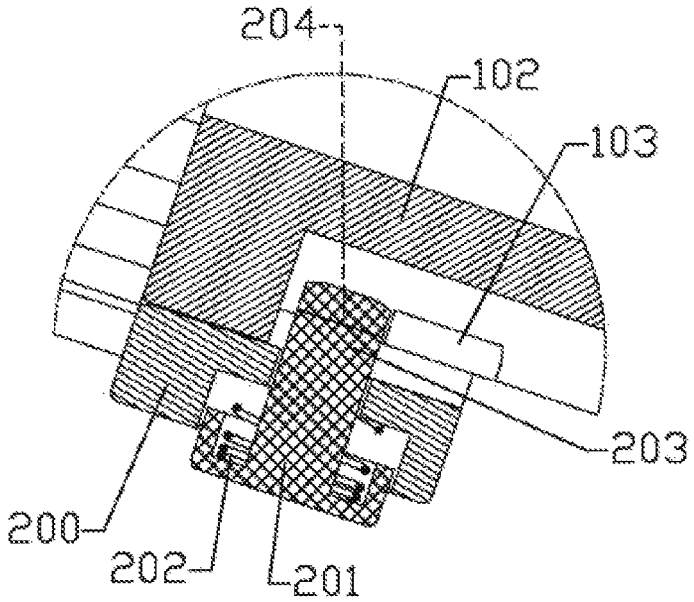
FIG. 10 is a partial sectional amplified view of FIG. 9 in the A-A direction.
Figure 11:
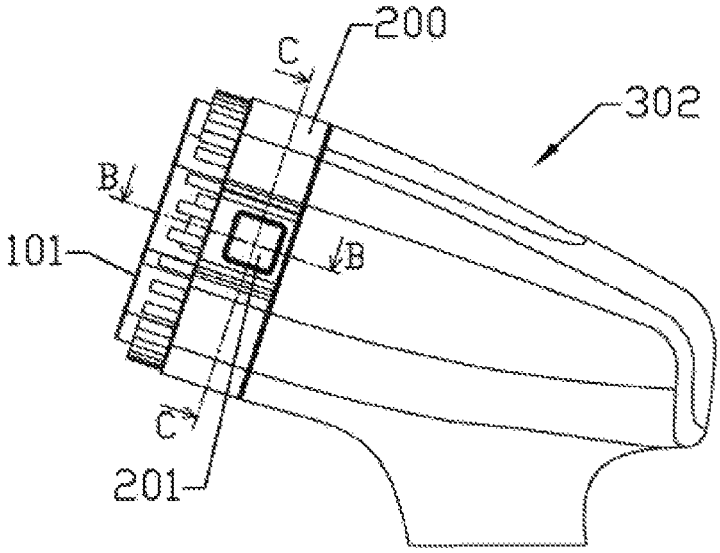
FIG. 11 is a schematic view in which the auxiliary accessory is located at an accommodating position when the structures in FIG. 6 are assembled together.
Figure 12:
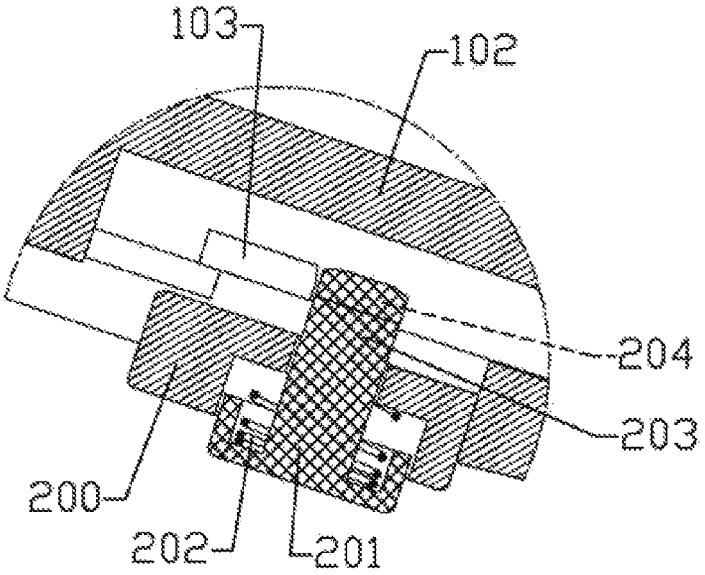
FIG. 12 is a partial sectional amplified view of FIG. 11 in the B-B direction.

An ironing head with an auxiliary accessory as shown in FIG. 6, FIG. 9 and FIG. 11 also includes a main body 100 and an auxiliary accessory 200. An ironing panel 101 is disposed at the front end of the main body 100. The main body 100 is provided with a neck 102 adjacent to the ironing panel; the auxiliary accessory 200 is movably sleeved on the neck 102; lock-up structures for positioning the auxiliary accessory at a working position (refer to FIGS. 9-10) and an accommodating position (refer to FIGS. 11-12) are disposed between the auxiliary accessory 200 and the main body 100, where the working position refers to the position, close to the ironing panel, of the auxiliary accessory sleeved on the neck, and the accommodating position refers to the position, away from the ironing panel, of the auxiliary accessory sleeved on the neck.

In this embodiment, the auxiliary accessory 200 is ring-shaped. Each one of the lock-up structures includes a lock 201 (refer to FIG. 7), a spring 201, and a stopper portions 103 (refer to FIG. 8). The stopper portions 103 are disposed at the neck 102. The locks 201 are equipped on the auxiliary accessory 200 in a telescoping way and protrude out of the surface of the auxiliary accessory to facilitate pressing. Each one of the springs 202 applies an outward spring force to each corresponding one of the locks 201 to maintain each corresponding one of the locks 201 at the position (refer to FIG. 10 and FIG. 12) blocked by each corresponding one of the stopper positions 103. Pressing each one of the locks 201 overcomes the spring force of each corresponding one of the springs 202 to move each corresponding one of the springs 202 inward so as to avoid blocking by each corresponding one of the stopper portions 103 (refer to FIG. 13). Therefore, the auxiliary accessory is positioned at the working position or accommodating position by using lock-up structures and pressing the locks moves the auxiliary accessory to change the position of the auxiliary accessory.

Figure 7:
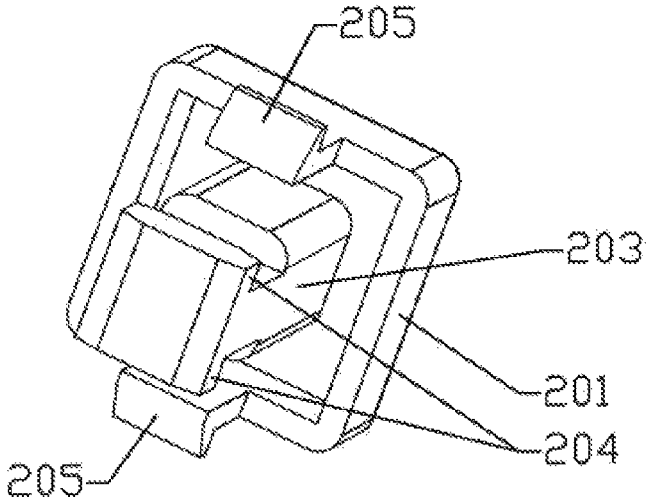
FIG. 7 is an amplified view of a lock in the FIG. 6.
Figure 8:
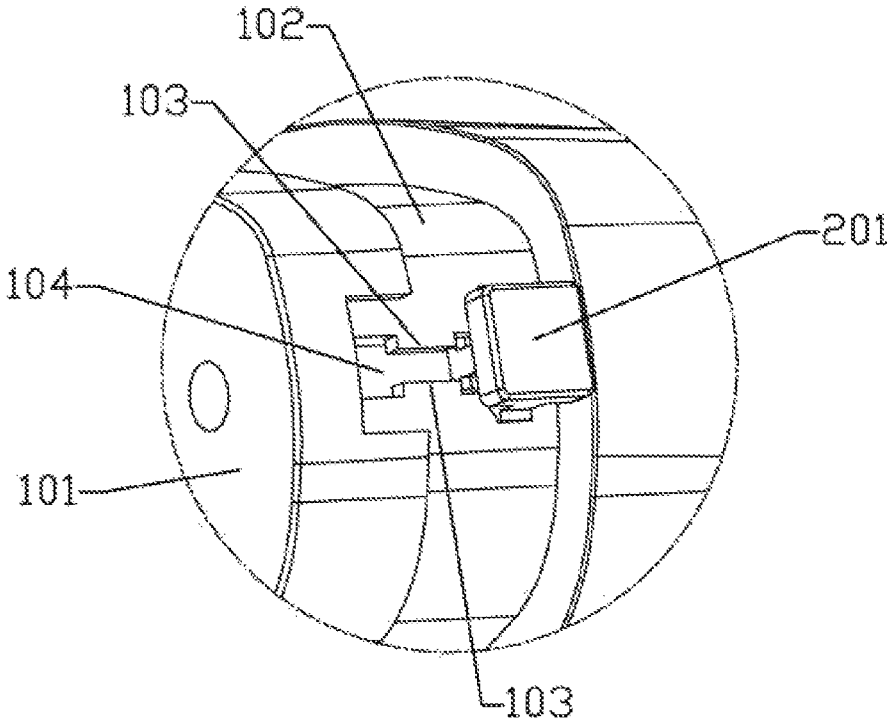
FIG. 8 is a schematic view of match between the lock in FIG. 6 with the slit and a stopper portion of the neck.
Figure 13:
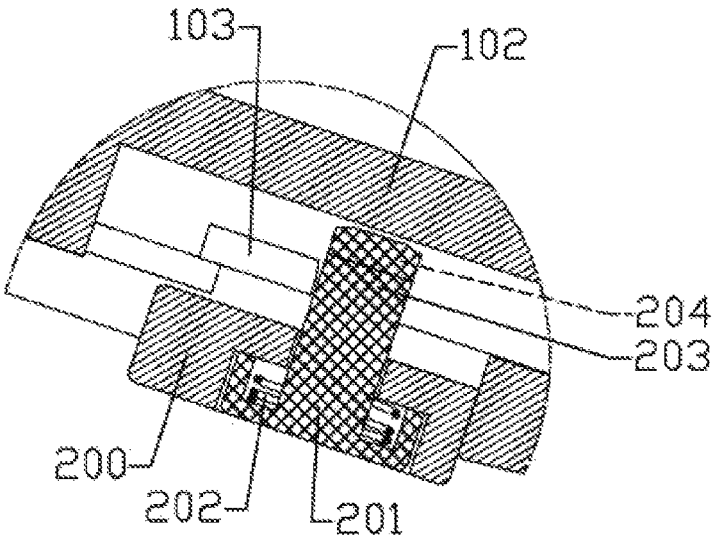
FIG. 13 is a schematic view in which the lock at the position as shown in FIG. 12 is pressed.

Specifically, in order to minimize the structure, and ensure reliable locking and positioning, as shown in FIG. 6 and FIG. 8, the neck 102 is provided with slits 104; each one of the stopper portions 103 is positioned at an edge of each corresponding one of the slits 104 and protrudes toward the inside of each corresponding one of the slits; each one of the locks 201 has a rod portion 203 (refer to FIG. 7, FIG. 10 and FIGS. 12-14); each one of the rod portions 203 extends into each corresponding one of the slits 104 and is provided with a lateral bolt 204 at the inner end; each one of bolts 204 is maintained by the spring force of each corresponding one of the springs 202 at the position blocked by each corresponding one of the stopper portions 103 (refer to FIG. 10, FIG. 12); pressing each one of the locks 201 overcomes the spring force of each corresponding one of the springs 202 to move each corresponding one of the bolts 204 inward so as to avoid blocking by each corresponding one of the stopper portions 103 (refer to FIG. 13). Each one of the springs 202 is a spiral compressed spring, and each one of the springs is sleeved on each corresponding one of the rod portions 203 and has two ends respectively supported on the auxiliary accessory 200 and each corresponding one of the locks 201. Each one of the stopper portions is positioned at the middle portion of each corresponding one of the slits such that the front and rear sides of each corresponding one of the stopper portions are both positioned in each corresponding one of the slits.

Figure 14:
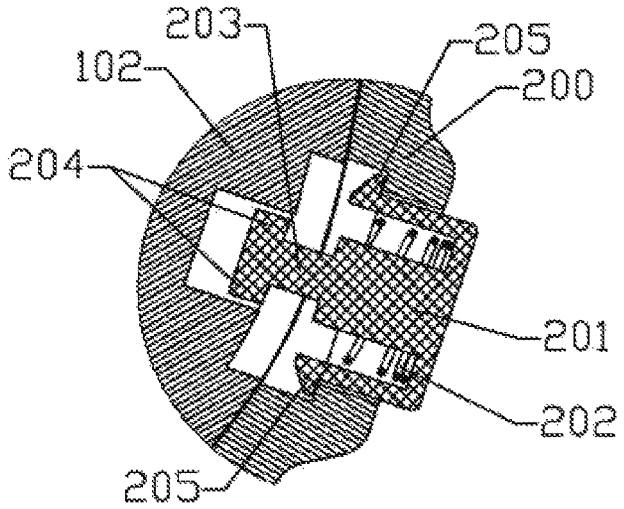
FIG. 14 is a partial sectional amplified view of FIG. 11 in the C-C direction.

Refer to FIG. 7 and FIG. 14, each one of the locks 201 is provided with two lateral hooks 205, and the lateral hooks 205 are positioned on the inner side of the auxiliary accessory 200 to realize assembling between the locks and the auxiliary accessory.

In this embodiment, two lock-up structures are symmetrically provided, which means that a set including a lock, a spring, a stopper portion and a slit is respectively disposed on each of the left and right sides of the neck and on the auxiliary accessory. The lock-up structures may also be disposed on the upper and lower sides and the auxiliary accessory.

The ironing head 302 with the auxiliary accessory of the embodiment as shown in the figure is also applied to the steam brush to become the head of the brush head. In view of the description on the steam brush in embodiment 1, details are omitted here.

Figure 15:
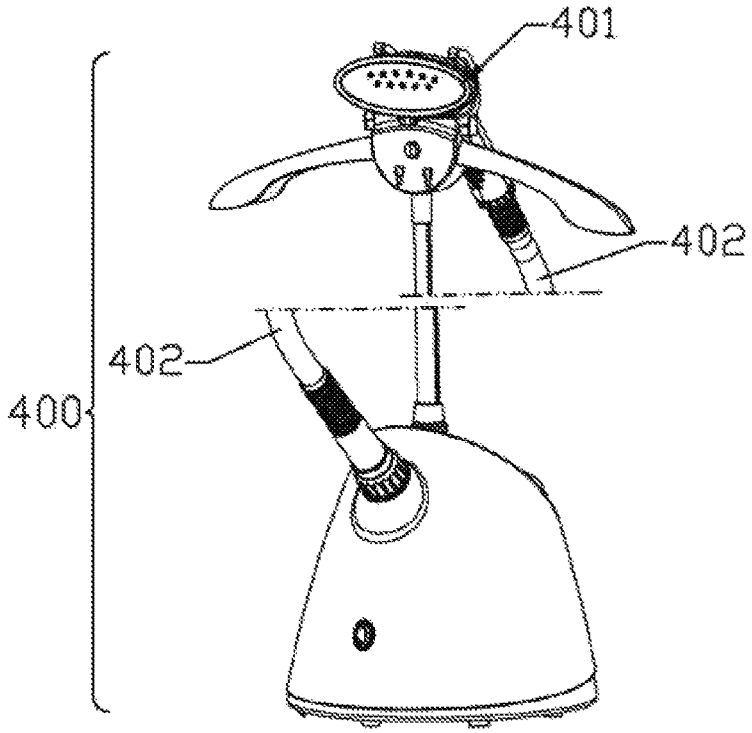
FIG. 15 is a schematic view of an ironing head with an auxiliary accessory of the present invention applied to a garment steamer.

Besides, the ironing head with the auxiliary accessory in embodiment 1 and embodiment 2 may also serve as the ironing head 401 of a garment steamer 400 as shown in FIG. 15. In such circumstances, the main body is connected with a steam generator of the garment steamer through a steam pipe 402.

In order to move the auxiliary accessory conveniently, the auxiliary accessory in embodiment 1 and embodiment 2 may be provided with a wrench (not shown in the figure). The wrench keeps a distance away from the ironing panel, avoiding scalding caused by touching the ironing panel.

The auxiliary accessory in embodiment 1 and embodiment 2 is provided with a hair brush or an electrostatic clothing brush.

What is claimed is:

1. An ironing head with an auxiliary accessory comprising:

a main body (100) having a neck (102);

an auxiliary accessory (200) having a ring-shape and being movably sleeved on the neck (102);

an ironing panel (101) being disposed at the front end of the main body (100);

a lock-up device for positioning the auxiliary accessory at a working position or an accommodating position being disposed between the auxiliary accessory (200) and the main body (100);

the lock-up device comprises a lock (201), a spring (202) and a stopper portion (103), the stopper portion (103) is disposed at the neck (102), the lock (201) is equipped on the auxiliary accessory in a telescoping way and protruded out on a surface of the auxiliary accessory to facilitate pressing, the spring (202) applies an outward spring force to the lock (201) to maintain the lock at the position blocked by of the stopper portion (103), and pressing the lock to move the lock inward so as to avoid blocking by the stopper portion.

2. The ironing head with an auxiliary accessory according to claim 1, wherein the accommodating position refers to a position away from the ironing panel, and the working position refers to the position, close to the ironing panel.

3. The ironing head with an auxiliary accessory according to claim 1, wherein the neck is provided with a slit (104), the stopper portion (103) is positioned at an edge of the slits (104) and protrudes towards the inside of the slits, the locks (201) has a rod portion (203) extending into slit (104), a lateral bolt (204) is provided at the inner end of the rod portion, the lateral bolt (204) is maintained by the spring force of the spring (202) at the position blocked by the stopper portion (103), pressing the lock (201) overcomes the spring force of the spring to move the lateral bolt (204) inward so as to avoid blocking by the stopper portion (103).

4. The ironing head with an auxiliary accessory according to claim 3, wherein the spring (202) is sleeved on the rod portion (203).

5. The ironing head with an auxiliary accessory according to claim 3, wherein the stopper portion is positioned at the middle portion of the slit such that the front and rear sides of the stopper portion are both positioned in the slit.

6. The ironing head with an auxiliary accessory according to claim 1, wherein the spring is a spiral compression spring.

7. The ironing head with an auxiliary accessory according to claim 1, wherein the lock (201) is provided with two lateral hooks (205), and the lateral hooks (205) are positioned on the inner side of the auxiliary accessory to realize assembling of the locks and the auxiliary accessory.

8. The ironing head with an auxiliary accessory according to claim 1, wherein two lock-up devices are symmetrical provided.

9. The ironing head with an auxiliary accessory according to claim 1, wherein the auxiliary accessory is provided with a hair brush or an electrostatic cloth brush.

10. The ironing head with an auxiliary accessory according to claim 1, wherein the main body is connected with a steam pipe which is connected with the steam generator (402).

11. The ironing head with an auxiliary accessory according to claim 1, wherein the main body is assembled with a water tank and a steam generator.

12. An ironing head with an auxiliary accessory comprising:

a main body (10) having a neck (12);

an auxiliary accessory (20) having a ring-shape and being movably sleeved on the neck (12);

an ironing panel (11) being disposed at the front end of the main body (10);

a lock-up device for positioning the auxiliary accessory at the working position or an accommodating position being disposed between the auxiliary accessory (20) and the main body (10);

the lock-up device comprises a positioning groove (21) and a spring bolt (13) respectively disposed on the auxiliary accessory and the neck, the spring bolt (13) is positioned in the positioning groove (21) to position the auxiliary accessory at the neck.

* * * * *